US007776499B2

(12) United States Patent
Wu et al.

(10) Patent No.: US 7,776,499 B2
(45) Date of Patent: Aug. 17, 2010

(54) OVERCOAT CONTAINING FLUORINATED POLY(OXETANE) PHOTOCONDUCTORS

(75) Inventors: Jin Wu, Webster, NY (US); Lanhui Zhang, Webster, NY (US); Lin Ma, Webster, NY (US); Dale S Renfer, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 436 days.

(21) Appl. No.: 12/033,267

(22) Filed: Feb. 19, 2008

(65) Prior Publication Data

US 2009/0208857 A1 Aug. 20, 2009

(51) Int. Cl.
*G03G 5/14* (2006.01)

(52) U.S. Cl. ..... 430/58.8; 430/66

(58) Field of Classification Search ..... 430/58.8, 430/66

See application file for complete search history.

(56) References Cited

U.S. PATENT DOCUMENTS

| | | | |
|---|---|---|---|
| 4,265,990 | A | 5/1981 | Stolka et al. |
| 4,298,697 | A | 11/1981 | Baczek et al. |
| 4,338,390 | A | 7/1982 | Lu |
| 4,560,635 | A | 12/1985 | Hoffend et al. |
| 4,654,284 | A | 3/1987 | Yu et al. |
| 5,021,309 | A | 6/1991 | Yu |
| 5,069,993 | A | 12/1991 | Robinette et al. |
| 5,096,795 | A | 3/1992 | Yu |
| 5,919,590 | A | 7/1999 | Yu et al. |
| 5,935,748 | A | 8/1999 | Yu et al. |
| 6,303,254 | B1 | 10/2001 | Yu et al. |
| 6,528,226 | B1 | 3/2003 | Yu et al. |
| 6,562,531 | B2 | 5/2003 | Niimi |
| 6,939,652 | B2 | 9/2005 | Yu |
| 2003/0158367 | A1 * | 8/2003 | Weinert et al. ..... 528/50 |
| 2004/0242804 | A1 * | 12/2004 | Medsker et al. ..... 525/407 |
| 2008/0004203 | A1 * | 1/2008 | Scheuing et al. ..... 510/475 |

OTHER PUBLICATIONS

Jin Wu et al., U.S. Application No. (not yet assigned) on Anticurl Backside Costing (ACBC) Photoconductors, filed concurrently herewith.

Jin Wu et al., U.S. Application No. (not yet assigned) on Backing Layer Containing Photoconductor, filed concurrently herewith.

Jin Wu et al., U.S. Application No. (not yet assigned) on Overcoated Photoconductors, filed concurrently herewith.

John F. Yanus et al., U.S. Appl. No. 11/593,875 on Silanol Containing Overcoated Photoconductors, filed Nov. 7, 2006.

John F. Yanus et al., U.S. Appl. No. 11/593,657 on Overcoated Photoconductors with Thiophosphate Containing Charge Transport Layers, filed Nov. 7, 2006.

John F. Yanus et al., U.S. Appl. No. 11/593,656 on Silanol Containing Charge Transport Overcoated Photoconductors, filed Nov. 7, 2006.

John F. Yanus et al., U.S. Appl. No. 11/593,662 on Overcoated Photoconductors with Thiophosphate Containing Photogenerating Layer, filed Nov. 7, 2006.

Jin Wu et al., U.S. Appl. No. 11/728,006 on Photoconductors Containing Fluorinated Components, filed Mar. 23, 2007.

Jin Wu et al., U.S. Appl. No. 11/728,013 on Photoconductor Fluorinated Charge Transport Layers, filed Mar. 23, 2007.

Jin Wu et al., U.S. Appl. No. 11/728,007 on Overcoated Photoconductors Containing Fluorinated Components, filed Mar. 23, 2007.

Jin Wu et al., U.S. Appl. No. 11/961,549 on Photoconductors Containing Ketal Overcoats, filed Dec. 20, 2007.

* cited by examiner

*Primary Examiner*—John L Goodrow
(74) *Attorney, Agent, or Firm*—E. O. Palazzo

(57) ABSTRACT

A photoconductor comprising a supporting substrate, a photogenerating layer, and at least one charge transport layer comprised of at least one charge transport component, and in contact with the charge transport layer an overcoat layer comprised of a fluorinated poly(oxetane) polymer.

33 Claims, No Drawings

OVERCOAT CONTAINING FLUORINATED POLY(OXETANE) PHOTOCONDUCTORS

CROSS REFERENCE TO RELATED APPLICATIONS

U.S. application Ser. No. 12/033,247, U.S. Publication 20090208859, filed Feb. 19, 2008 entitled Anticurl Backside Coating (ACBC) Photoconductors, the disclosure of which is totally incorporated herein by reference, discloses a photoconductor comprising a first layer, a supporting substrate thereover, a photogenerating layer, and at least one charge transport layer comprised of at least one charge transport component, and wherein the first layer is in contact with the supporting substrate on the reverse side thereof, and which first layer is comprised of a fluorinated poly(oxetane) polymer.

U.S. application Ser. No. 12/033,276, U.S. Publication 20090208856, filed Feb. 19, 2008 entitled Overcoated Photoconductors, the disclosure of which is totally incorporated herein by reference, discloses a photoconductor comprising an optional supporting substrate, a photogenerating layer, and at least one charge transport layer, and wherein at least one charge transport layer contains at least one charge transport component; and an overcoating layer in contact with and contiguous to the charge transport layer, and which overcoating is comprised of a self crosslinked acrylic resin, a charge transport component, and a low surface energy additive.

U.S. application Ser. No. 12/033,279, U.S. Publication 20090208858, filed Feb. 19, 2008 entitled Backing Layer Containing Photoconductor, the disclosure of which is totally incorporated herein by reference, a photoconductor comprising a substrate, an imaging layer thereon, and a backing layer located on a side of the substrate opposite the imaging layer wherein the outermost layer of the backing layer adjacent to the substrate is comprised of a self crosslinked acrylic resin and a crosslinkable siloxane component.

The following related photoconductor applications are also being recited. The disclosures of each of the following copending applications are totally incorporated herein by reference.

U.S. application Ser. No. 11/593,875, filed Nov. 7, 2006 on Silanol Containing Overcoated Photoconductors, by John F. Yanus et al., which discloses an imaging member comprising an optional supporting substrate, a silanol containing photogenerating layer, and at least one charge transport layer comprised of at least one charge transport component and an overcoating layer in contact with and contiguous to the charge transport, and which overcoating is comprised of an acrylated polyol, a polyalkylene glycol, a crosslinking agent, and a charge transport component.

U.S. application Ser. No. 11/593,657, filed Nov. 7, 2006 on Overcoated Photoconductors With Thiophosphate Containing Charge Transport Layers, which discloses, for example, an imaging member comprising an optional supporting substrate, a photogenerating layer, and at least one charge transport layer, and wherein at least one charge transport layer contains at least one charge transport component and at least one thiophosphate; and an overcoating layer in contact with and contiguous to the charge transport layer, and which overcoating is comprised of an acrylated polyol, a polyalkylene glycol, a crosslinking component, and a charge transport component.

U.S. application Ser. No. 11/593,656, filed Nov. 7, 2006 on Silanol Containing Charge Transport Overcoated Photoconductors, by John F. Yanus et al., which discloses an imaging member comprising an optional supporting substrate, a photogenerating layer, and at least one charge transport layer comprised of at least one charge transport component and at least one silanol; and an overcoating in contact with and contiguous to the charge transport layer, and which overcoating is comprised of an acrylated polyol, a polyalkylene glycol, a crosslinking component, and a charge transport component.

U.S. application Ser. No. 11/593,662, filed Nov. 7, 2006 on Overcoated Photoconductors with Thiophosphate Containing Photogenerating Layer, by John F. Yanus et al., which discloses an imaging member comprising an optional supporting substrate, a photogenerating layer, and at least one charge transport layer, and wherein the photogenerating layer contains at least one thiophosphate, and an overcoating layer in contact with and contiguous to the charge transport layer, and which overcoating is comprised of an acrylated polyol, a polyalkylene glycol, a crosslinking component, and a charge transport component.

U.S. application Ser. No. 11/728,006, filed Mar. 23, 2007 by Jin Wu et al. on Photoconductors Containing Fluorinated Components, discloses a photoconductor comprising a layer comprised of a polymer and a fluoroalkyl ester; thereover a supporting substrate, a photogenerating layer, and at least one charge transport layer.

U.S. application Ser. No. 11/728,013, filed Mar. 23, 2007 by Jin Wu et al. on Photoconductor Fluorinated Charge Transport Layers, discloses a photoconductor comprising an optional supporting substrate, a photogenerating layer, and at least one fluoroalkyl ester containing charge transport layer.

U.S. application Ser. No. 11/728,007, filed Mar. 23, 2007 by Jin Wu et al. on Overcoated Photoconductors Containing Fluorinated Components, discloses a photoconductor comprising an optional supporting substrate, a photogenerating layer, at least one charge transport layer, and an overcoating layer in contact with and contiguous to the charge transport layer, and which overcoating is comprised of a fluoroalkyl ester, and a polymer.

U.S. application Ser. No. 11/961,549, filed Dec. 20, 2007 by Jin Wu et al. on Photoconductors Containing Ketal Overcoats, discloses a photoconductor comprising a supporting substrate, a photogenerating layer, and at least one charge transport layer comprised of at least one charge transport component, and an overcoat layer in contact with and contiguous to the charge transport layer, and which overcoat is comprised of a crosslinked polymeric network, an overcoat charge transport component, and at least one ketal.

BACKGROUND

This disclosure is generally directed to layered imaging members, photoreceptors, photoconductors, and the like. More specifically, the present disclosure is directed to multilayered drum, or flexible, belt imaging members, or devices comprised of a supporting medium like a substrate, a photogenerating layer, a charge transport layer, including a plurality of charge transport layers, such as a first charge transport layer and a second charge transport layer, an optional adhesive layer, an optional hole blocking or undercoat layer, and a fluorinated poly(oxetane) polymer overcoat layer, and wherein the supporting substrate is situated between the first layer and the photogenerating layer. More specifically, the photoconductors disclosed are comprised of a fluorinated poly(oxetane) polymer, especially a soluble, in, for example, an alkylene halide like methylene chloride, fluorinated poly (oxetane) polymer top layer of, for example, a charge transport layer, a polymeric overcoat layer or a PASCO overcoat. With the soluble fluorinated polymer, the top or overcoat layer possesses a desirable low surface energy, thus the wear resistance of this layer is excellent especially as compared to a polytetrafluoroethylene (PTFE) containing top layer. Moreover, the top layer of the present disclosure contains an environmentally non-hazardous soluble fluorinated polymer as compared, for example, to PTFE; the solution containing the fluorinated poly(oxetane) polymer is stable for extended time periods, and avoids the use of the undesirable perfluorooctane acid (PFOA) in the preparation of the fluorinated poly(oxetane) polymer; minimal agglomeration of the top layer components in place of the larger particles of PTFE, the use of small molecule additives of fluorinated poly(oxetane) polymer that substantially avoid the escape of the polymer particles that adversely impact the systems in which the top layer is present; and other advantages as illustrated herein for photoconductors with overcoat layers comprising a fluorinated poly(oxetane) polymer.

In embodiments, the photoconductors disclosed include a charge transport top layer, and which layer can be solution coated, for example, as a self-adhesive layer may comprise a number of suitable fluorinated poly(oxetane) materials, such as those components that substantially reduce surface contact friction and prevent or minimize wear/scratch problems for the photoconductor device. In embodiments, the mechanically robust top photoconductor layer of the present disclosure usually will not substantially reduce the layer's thickness over extended time periods and adversely affect its protective and electrical characteristics; minimizes causing print defects which thereby prevent the imaging process from continuously allowing a satisfactory copy printout quality; moreover, the top layer also may generate dirt and debris resulting, for example, in undesirable dusty machine operation condition and effective cycling. Low surface energy surface layers, such as charge transport layers and overcoat layer, permit photoconductors with improved wear resistance, emulsion/aggregation toner cleanability, and excellent anti-filming properties; and the fluorinated poly(oxetane) polymers enable a uniform and stable solution; minimize lateral charge migration (LCM) caused primarily by the interactions of some of the top layer components.

Also included within the scope of the present disclosure are methods of imaging and printing with the photoresponsive or photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the toner image to a suitable image receiving substrate, and permanently affixing the image thereto. In those environments wherein the device is to be used in a printing mode, the imaging method involves the same operation with the exception that exposure can be accomplished with a laser device or image bar. More specifically, the flexible photoconductor belts disclosed herein can be selected for the Xerox Corporation iGEN® machines that generate with some versions over 100 copies per minute. Processes of imaging, especially xerographic imaging and printing, including digital, and/or color printing, are thus encompassed by the present disclosure. The imaging members are in embodiments sensitive in the wavelength region of, for example, from about 400 to about 900 nanometers, and in particular from about 650 to about 850 nanometers, thus diode lasers can be selected as the light source. Moreover, the imaging members of this disclosure are useful in color xerographic applications, particularly high-speed color copying and printing processes.

REFERENCES

There are illustrated in U.S. Pat. No. 6,562,531, the disclosure of which is totally incorporated herein by reference, photoconductors with protective layers containing fillers, such as fillers with certain resistivities, such as alumina, metal oxides, polytetrafluoroethylene, silicone resins, amorphous carbon powders, powders of metals like copper, tin, and the like.

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer.

In U.S. Pat. No. 4,587,189, the disclosure of which is totally incorporated herein by reference, there is illustrated a layered imaging member with, for example, a perylene, pigment photogenerating component and an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport, can be selected for the imaging members or photoconductors of the present disclosure in embodiments thereof.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises as a first step hydrolyzing a gallium phthalocyanine precursor pigment by dissolving the hydroxygallium phthalocyanine in a strong acid, and then reprecipitating the resulting dissolved pigment in basic aqueous media.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The appropriate components, such as the supporting substrates, the photogenerating layer components, the charge transport layer components, the overcoating layer components, and the like, of the above-recited patents may be selected for the photoconductors of the present disclosure in embodiments thereof.

EMBODIMENTS

Aspects of the present disclosure relate to a photoconductor comprising a supporting substrate, a photogenerating layer, and at least one charge transport layer comprised of at least one charge transport component, and in contact with the charge transport layer an overcoat layer comprised of a polymer, an optional charge transport component, and a fluorinated poly(oxetane) polymer; a photoconductor wherein the fluorinated poly(oxetane) polymer is a fluorinated poly(oxetane) homopolymer represented by the following structures/formulas

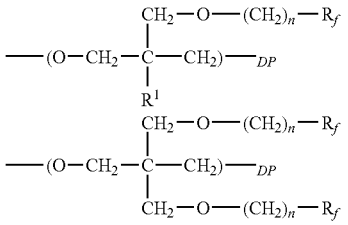

wherein $R^1$ is an alkyl having from 1 to 6 carbon atoms or hydrogen; n is independently an integer or number of from 1 to about 6; $R_f$ is a fluorinated aliphatic group with, for example, from 1 to about 30 carbon atoms; and DP is the degree of polymerization of, for example, from 2 to about 100; a photoconductor wherein the fluorinated poly(oxetane) homopolymer is polymerized from a plurality of fluorinated oxetane monomers represented by the following structures/formulas

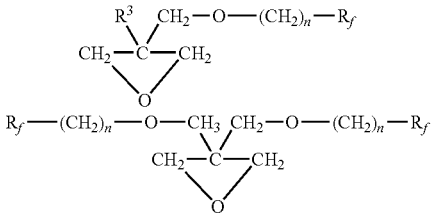

wherein $R^1$ is an alkyl with, for example, from 1 to about 4 carbon atoms; n is an integer or number of, for example, from 1 to about 4; and $R_f$ is a fluorinated aliphatic group with, for example, from 3 to about 15 carbon atoms; a photoconductor wherein the fluorinated poly(oxetane) homopolymer is represented by the following structures/formulas

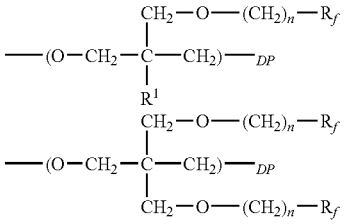

wherein $R^1$ is alkyl like methyl; n is from 1 to about 3; $R_f$ is a perfluorinated linear aliphatic group with from 1 to about 10 carbon atoms; and DP, degree of polymerization, is from 3 to about 50; a photoconductor wherein the fluorinated poly(oxetane) polymer is a fluorinated poly(oxetane) copolymer of a fluorinated poly(oxetane) and an olefin polymer or copolymer, or a hydrogenated diene polymer or copolymer; a photoconductor wherein the fluorinated poly(oxetane) copolymer is a block copolymer of a fluorinated poly(oxetane) and an olefin polymer or copolymer, and the fluorinated poly(oxetane) block is represented by the following structures/formulas

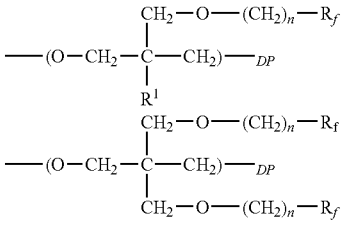

wherein $R^1$ is an alkyl with from 1 to 6 carbon atoms or hydrogen; n is from 1 to about 6; $R_f$ is a fluorinated aliphatic group having from 1 to about 30 carbon atoms; and DP, the degree of polymerization, is from 2 to about 100; and the olefin polymer or copolymer block is derived from at least one olefin monomer having from 2 to about 8 carbon atoms with a number average molecular weight of from about 200 to about 4,000; a photoconductor wherein $R^1$ is methyl; n is from 1 to about 2; $R_f$ is a perfluorinated linear aliphatic group having from 1 to about 10 carbon atoms; and DP, the degree of polymerization, is from 3 to about 40 of the fluorinated poly(oxetane) block; a photoconductor wherein the fluorinated poly(oxetane) copolymer is a block copolymer of a fluorinated poly(oxetane) and a hydrogenated diene polymer or a copolymer thereof, and the fluorinated poly(oxetane) block is represented by the following structures/formulas

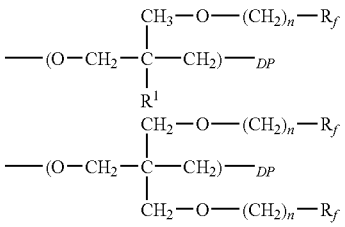

wherein $R^1$ is an alkyl with from 1 to 6 carbon atoms or hydrogen; n is from 1 to about 6; $R_f$ is a fluorinated aliphatic group having from 1 to about 30 carbon atoms; and DP, the degree of polymerization, is from 2 to about 100; and the hydrogenated diene polymer or copolymer block is derived from at least one conjugated diene monomer having from 4 to about 10 carbon atoms with a number average molecular weight of from about 500 to about 15,000; a photoconductor wherein $R^{f}$ is methyl or ethyl; n is from 1 to about 4; $R_{f}$ is a perfluorinated linear aliphatic group having from 1 to about 10 carbon atoms; and DP, the degree of polymerization, is from 3 to about 40 of the fluorinated poly(oxetane) block, and the hydrogenated diene polymer or copolymer block possesses a number average molecular weight of from about 1,000 to 8,000; a photoconductor wherein the fluorinated poly(oxetane) polymer is selected from the group consisting of the following structures/formulas

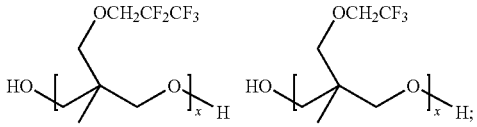

wherein x is about 6, or about 20

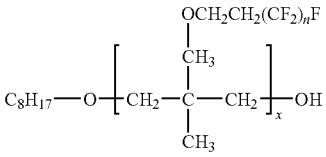

wherein x is about 4.5, and n is about 8

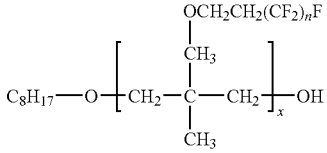

wherein x is about 18, and n is about 8

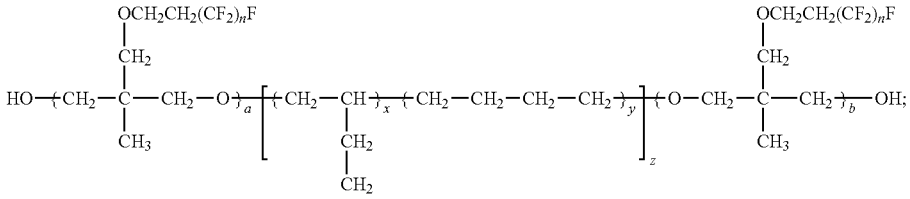

wherein x is about 2; y is about 8; z is about 160; a + b is about 6, and n is about 8 a photoconductor wherein the supporting substrate is comprised of a single layer; a photoconductor wherein the charge transport component is comprised of at least one of aryl amine molecules

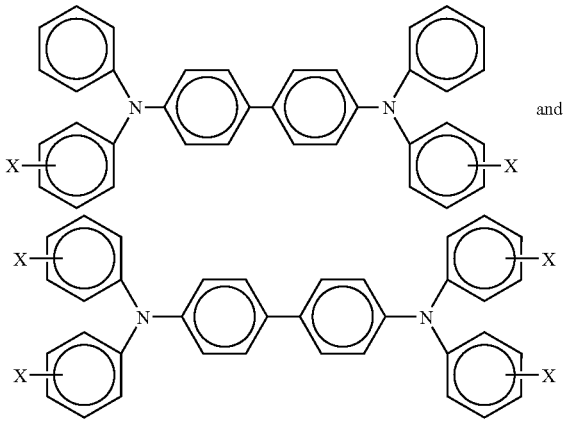

and wherein X is selected from the group consisting of at least one of alkyl, alkoxy, aryl, and halogen; a photoconductor wherein the alkyl and the alkoxy each contains from about 1 to about 12 carbon atoms, and the aryl contains from about 6 to about 36 carbon atoms; a photoconductor wherein the aryl amine is N,N'-diphenyl-N,N-bis(3-methylphenyl)-1,1'-biphenyl-4,4'-diamine; a photoconductor wherein the charge transport component is comprised of

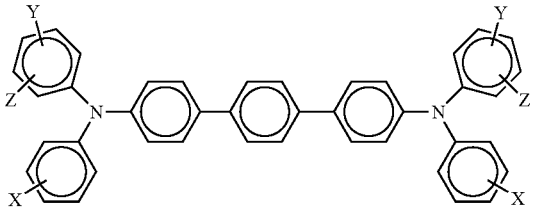

wherein X, Y and Z are independently selected from the group consisting of at least one of alkyl, alkoxy, aryl, and halogen; a photoconductor wherein alkyl and alkoxy each contains from about 1 to about 12 carbon atoms, and aryl contains from about 6 to about 36 carbon atoms; a photoconductor wherein the charge transport component is an aryl amine selected from the group consisting of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, and optionally mixtures thereof; a photoconductor wherein the charge transport component is comprised of aryl amine mixtures; a photoconductor wherein the member further includes in at least one of the charge transport layers and overcoat layer an antioxidant comprised of a hindered phenolic and a hindered amine; a photoconductor wherein the photogenerating layer is comprised of a photogenerating pigment or photogenerating pigments; a photoconductor wherein the photogenerating pigment is comprised of at least one of a metal phthalocyanine, metal free phthalocyanine, a bis(benzimidazo)perylene, and mixtures thereof; a photoconductor further including a hole blocking layer, and an adhesive layer, and wherein the substrate is comprised of a conductive material; a photoconductor wherein the substrate is a flexible web; a photoconductor wherein the at least one charge transport layer is from 1 to about 7 layers; a photoconductor wherein the at least one charge transport layer is from 1 to about 2 layers; a photoconductor wherein the at least one charge transport layer is comprised of a top charge transport layer and a bottom charge transport layer, and wherein the top layer is in contact with the overcoating layer, and the bottom layer is in contact with the photogenerating layer; a photoconductor comprised in sequence of a supporting substrate, a photogenerating layer thereover, a charge transport layer, and in contact with and contiguous to the charge transport layer an overcoat layer comprised of a polymer, an optional charge transport component and an additive, wherein the additive is comprised of at least one of the following structures/formulas

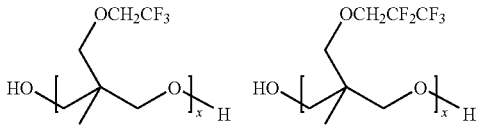

wherein x represents the number of repeating units or segments of from about 3 to about 30; a photoconductor wherein the additive is present in an amount of from about 0.05 to about 20 weight percent; a photoconductor wherein the additive is present in an amount of from about 0.5 to about 10 weight percent; a photoconductor wherein the top layer is of a thickness of from about 0.5 to about 10 microns, and wherein the additive is present in an amount of from about 1 to about 5 weight percent; a photoconductor comprised in sequence of a supporting substrate, a photogenerating layer thereover, a charge transport layer, and an overcoat layer comprised of a fluorinated poly(oxetane) polymer additive of at least one of the following formulas/structures

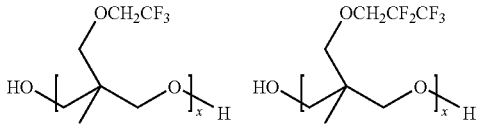

wherein x represents a number of from about 3 to about 50, and which additive is present in an amount of from about 0.5 to about 30 weight percent; and a photoconductor wherein the fluorinated poly(oxetane) polymer additive is present in an amount of from about 0.1 to about 10 weight percent; and which layer further includes a polymer present in an amount of from about 40 to about 99.9 weight percent, and a charge transport component in an amount of from about 0 to about 50 weight percent, and the total component amount is 100 weight percent; a photoconductor wherein the additive is of the following formula/structure

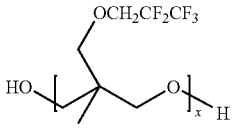

and is present in an amount of from about 1 to about 5 weight percent, and wherein x is from about 3 to about 30.

The photoconductor top coating layer with, for example, a thickness of from about 0.1 to about 75, from about 0.5 to about 35, or from about 1 to about 15 microns, comprises a fluorinated, especially a soluble fluorinated poly(oxetane) polymer present in various suitable amounts, such as from about 0.05 to about 20, from about 0.1 to about 15, from 1 to about 10, and from 2 to about 5 weight percent.

The fluorinated poly(oxetane) polymers include fluorinated poly(oxetane) homopolymers or polyfluorooxetanes, and fluorinated poly(oxetane) copolymers such as block copolymers of fluorinated poly(oxetane) and olefin polymer or copolymer.

Fluorinated poly(oxetane) homopolymers can be polymerized from a plurality of fluorinated oxetane monomers (cyclic ethers) as illustrated below

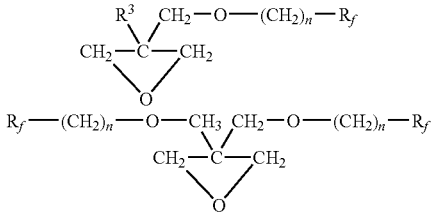

by a cationic or anionic mechanism, wherein $R^1$ is an alkyl having from 1 to 6 carbon atoms or hydrogen with methyl being preferred; n is from 1 to about 6, from 1 to about 4, or from 1 to about 2; $R_f$ is a fluorinated aliphatic group having from 1 to about 30, from about 3 to about 15, or from about 6 to about 10 carbon atoms. Also, a plurality of fluorinated oxetane monomers, either containing the same or different $R_f$ groups, $R^1$ groups, can be polymerized together. Thus, the fluorinated poly(oxetane) homopolymers disclosed herein may in embodiments be referred to as copolymers.

The fluorinated poly(oxetane) homopolymers formed contain the following repeating units or segments

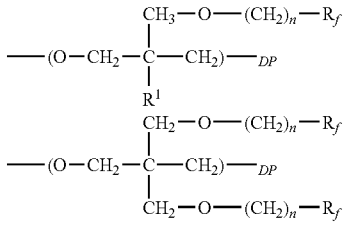

wherein each $R_f$ group, $R^1$ group or n is as illustrated herein, and DP, the degree of polymerization, represents the number of repeating units of, for example, from 2 to about 100, or from 3 to about 50.

Fluorinated poly(oxetane) copolymers include copolymers, such as block copolymers of a fluorinated poly(oxetane) and an olefin polymer or copolymer derived from at least one olefin monomer having from 2 to about 8 carbon atoms, and block copolymers of a fluorinated poly(oxetane) and a hydrogenated diene polymer or copolymers derived from at least one conjugated diene monomer having from 4 to about 10 carbon atoms. The repeating unit, or degree of polymerization (DP) of the fluorinated poly(oxetane) block is, for example, from about 3 to about 45; the number average molecular weight of the olefin polymer or copolymer block is from about 200 to about 4,000; the number average molecular weight of the hydrogenated diene polymer or copolymer block is from about 500 to about 15,000, or from about 1,000 to 8,000.

Specific examples of the fluorinated poly(oxetane) homopolymers include POLYFOX™ PF-636 (x=6), POLYFOX™ PF-6320 (x=20) with the following structure/formula

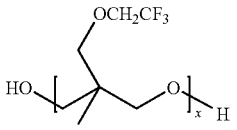

and POLYFOX™ PF-656 (x=6), POLYFOX™ PF-6520 (x=20) with the following structure/formula

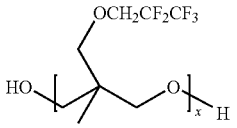

POLYFOX™ additives are commercially available from OMNOVA Solutions Inc., Akron, Ohio.

Other specific examples of the fluorinated poly(oxetane) homopolymers are represented by the following structures/formulas

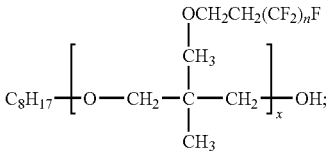

wherein x is about 4.5, and n is about 8

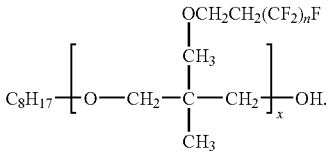

wherein x is about 18, and n is about 8

A specific example of a fluorinated poly(oxetane) copolymer is represented by the following structure/formula wherein x is about 2; y is about 8; z is about 160; a+b is about 6.

The above synthesis of the fluorinated poly(oxetane) polymers is environmentally nonhazardous since there is no, or essentially no perfluorooctane acid (PFOA) involved in the process; and also there is believed to be a strong interaction between the fluorinated poly(oxetane) polymers and polycarbonates, which tends to retain the fluoro additives across the surface layer instead of concentrating it on the surface.

The top coating layer comprises an optional charge transport component and at least one polymer. Examples of polymers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene)carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl) carbonate (also referred to as bisphenol-C-polycarbonate), and the like. In embodiments, the polymer is comprised of a polycarbonate resin with a molecular weight $M_w$ of from about 20,000 to about 100,000, and more specifically, with a molecular weight $M_w$ of from about 50,000 to about 100,000. Additionally, in embodiments, the fluorinated poly(oxetane) polymer can be included in the top layer, the charge transport layer in contact with the top layer or in both the top layer and the charge transport layer. The photoconductor top layer with, for example, a thickness of from about 0.1 to about 10, from about 0.5 to about 5, or from about 1 to about 3 microns, comprises a fluorinated, especially a soluble fluorinated poly(oxetane) polymer, present in various suitable amounts, such as from about 0.05 to about 20, from about 0.1 to about 15, from 1 to about 10, from 2 to about 5 weight percent; and the photoconductor charge transport layer with, for example, a thickness of from about 10 to about 75, from about 15 to about 45, or from about 20 to about 35 microns, comprises a fluorinated, especially a soluble fluorinated poly (oxetane) polymer, present in various suitable amounts, such as from about 0.01 to about 10, from about 0.05 to about 5, or from 0.5 to about 2 weight percent.

The thickness of the photoconductor substrate layer depends on many factors, including economical considerations, electrical characteristics, adequate flexibility, and the like, thus this layer may be of substantial thickness, for example over 3,000 microns, such as from about 1,000 to about 2,000 microns, from about 500 to about 1,000 microns, or from about 300 to about 700 microns, ("about" throughout includes all values in between the values recited) or of a minimum thickness. In embodiments, the thickness of this

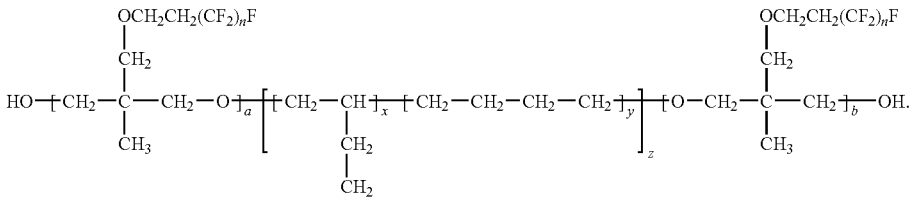

wherein x is about 2; y is about 8; z is about 160; a + b is about 6 layer is from about 75 microns to about 300 microns, or from about 100 to about 150 microns.

The photoconductor substrate may be opaque or substantially transparent, and may comprise any suitable material having the required mechanical properties. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, this layer may be of a substantial thickness of, for example, up to many centimeters, or of a minimum thickness of less than a millimeter. Similarly, a flexible belt may be of a substantial thickness of, for example, about 250 micrometers, or of a minimum thickness of less than about 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, supporting substrate layers selected for the imaging members of the present disclosure, and which substrates can be opaque or substantially transparent, comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo) perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume. The maximum thickness of this layer in embodiments is dependent primarily upon factors, such as photosensitivity, electrical properties and mechanical considerations.

The photogenerating composition or pigment is present in the resinous binder composition in various amounts. Generally, however, from about 5 percent by volume to about 95 percent by volume of the photogenerating pigment is dispersed in about 95 percent by volume to about 5 percent by volume of the resinous binder, or from about 20 percent by volume to about 30 percent by volume of the photogenerating pigment is dispersed in about 70 percent by volume to about 80 percent by volume of the resinous binder composition. In one embodiment, about 90 percent by volume of the photogenerating pigment is dispersed in about 10 percent by volume of the resinous binder composition, and which resin may be selected from a number of known polymers, such as poly (vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like, hydrogenated amorphous silicon and compounds of silicon and germanium, carbon, oxygen, nitrogen and the like fabricated by vacuum evaporation or deposition. The photogenerating layers may also comprise inorganic pigments of crystalline selenium and its alloys; Groups II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos, and the like dispersed in a film forming polymeric binder and fabricated by solvent coating techniques.

In embodiments, examples of polymeric binder materials that can be selected as the matrix for the photogenerating layer are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrene-butadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers.

Various suitable and conventional known processes may be used to mix, and thereafter apply the photogenerating layer coating mixture, like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The coating of the photogenerating layer in embodiments of the present disclosure can be accomplished with spray, dip or wire-bar methods such that the final dry thickness of the photogenerating layer is as illustrated herein, and can be, for example, from about 0.01 to about 30 microns after being dried at, for example, about 40° C. to about 150° C. for about 15 to about 90 minutes. More specifically, a photogenerating layer of a thickness, for example, of from about 0.1 to about 30, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking or hole blocking layer, or interfacial layer and the photogenerating layer. Usually, the photogenerating layer is applied onto the blocking layer and a charge transport layer or plurality of charge transport layers are formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As optional adhesive layers usually in contact with or situated between the hole blocking layer and the photogenerating layer, there can be selected various known substances inclusive of copolyesters, polyamides, poly(vinyl butyral), poly (vinyl alcohol), polyurethane, and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The hole blocking or undercoat layers for the imaging members of the present disclosure can contain a number of components including known hole blocking components, such as amino silanes, doped metal oxides, TiSi, a metal oxide like titanium, chromium, zinc, tin, and the like; a mixture of phenolic compounds and a phenolic resin or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound preferably containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion are added a phenolic compound and dopant, followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol, and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Border Chemical).

The optional hole blocking layer may be applied to the substrate. Any suitable and conventional blocking layer capable of forming an electronic barrier to holes between the adjacent photoconductive layer (or electrophotographic imaging layer) and the underlying conductive surface of substrate may be selected.

A number of charge transport compounds can be included in the charge transport layer, which layer generally is of a thickness of from about 5 microns to about 75 microns, and more specifically, of a thickness of from about 10 microns to about 40 microns. Examples of charge transport components are aryl amines of the following formulas/structures

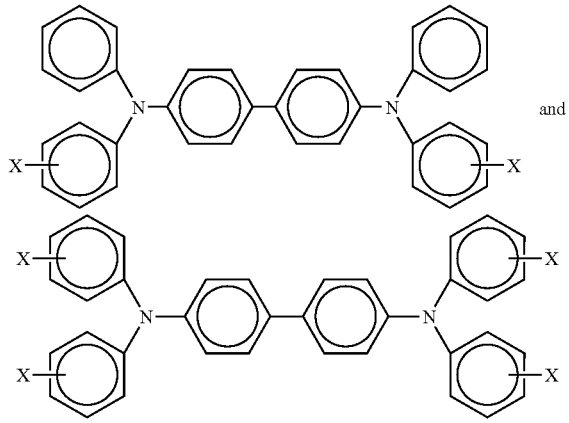

and wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas/structures

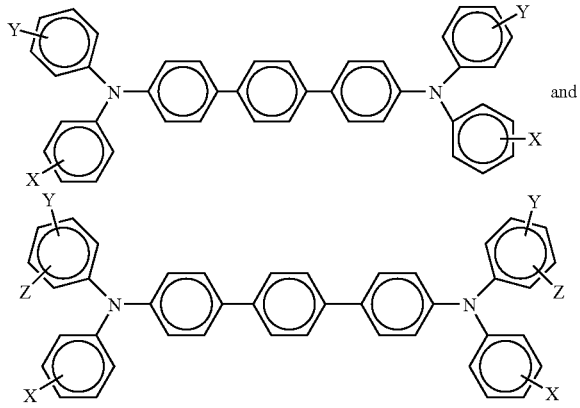

and wherein X, Y and Z are independently alkyl, alkoxy, aryl, a halogen, or mixtures thereof; and wherein at least one of Y and Z are present. Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene) carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl) carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer, may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, "charge transport" refers, for example, to charge transporting molecules as a monomer that allows the free charge generated in the photogenerating layer to be transported across the transport layer.

Examples of hole transporting molecules present, for example, in an amount of from about 50 to about 75 weight percent, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl) carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments, to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency and transports them across the charge transport layer with short transit times includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material, or a combination of a small molecule charge transport material and a polymeric charge transport material.

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NR, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20, from about 1 to about 10, or from about 3 to about 8 weight percent.

A number of processes may be used to mix, and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is from about 10 to about 70 micrometers, but thicknesses outside this range may, in embodiments, also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer. Typical application techniques include spraying, dip coating, roll coating, wire wound rod coating, and the like. Drying of the deposited coating may be effected by any suitable conventional technique, such as oven drying, infrared radiation drying, air drying, and the like. An optional top overcoating layer, such as the overcoating of copending U.S. application Ser. No. 11/593,875, the disclosure of which is totally incorporated herein by reference, may be applied over the charge transport layer to provide abrasion protection.

Aspects of the present disclosure relate to a photoconductive imaging member comprised of a first ACBC layer, a supporting substrate, a photogenerating layer, a charge transport layer, and an overcoating charge transport layer; a photoconductive member with a photogenerating layer of a thickness of from about 0.1 to about 10 microns, and at least one transport layer, each of a thickness of from about 5 to about 100 microns; an imaging method and an imaging apparatus containing a charging component, a development component, a transfer component, and a fixing component, and wherein the apparatus contains a photoconductive imaging member comprised of a first layer, a supporting substrate, and thereover a layer comprised of a photogenerating pigment and a charge transport layer or layers, and thereover an overcoat charge transport layer, and where the transport layer is of a thickness of from about 40 to about 75 microns; a member wherein the photogenerating layer contains a photogenerating pigment present in an amount of from about 5 to about 95 weight percent; a member wherein the thickness of the photogenerating layer is from about 0.1 to about 4 microns; a member wherein the photogenerating layer contains a polymer binder; a member wherein the binder is present in an amount of from about 50 to about 90 percent by weight, and wherein the total of all layer components is about 100 percent; a member wherein the photogenerating component is a hydroxygallium phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating pigment is a metal free phthalocyanine; an imaging member wherein each of the charge transport layers comprises

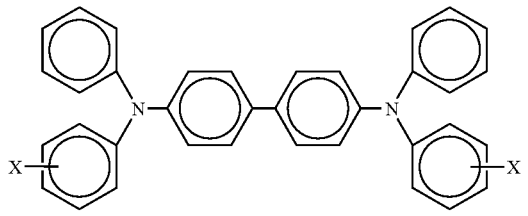

wherein X is selected from the group consisting of alkyl, alkoxy, aryl, and halogen; an imaging member wherein alkyl and alkoxy contains from about 1 to about 12 carbon atoms; an imaging member wherein alkyl contains from about 1 to about 5 carbon atoms; an imaging member wherein alkyl is methyl; an imaging member wherein each of, or at least one of the charge transport layers comprises

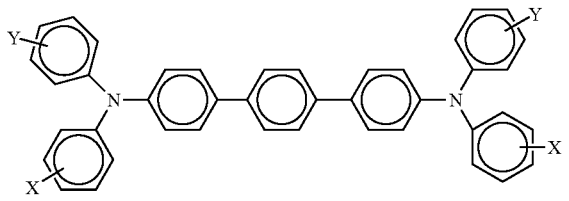

wherein X and Y are independently alkyl, alkoxy, aryl, a halogen, or mixtures thereof; an imaging member wherein alkyl and alkoxy contains from about 1 to about 12 carbon atoms; an imaging member wherein alkyl contains from about 1 to about 5 carbon atoms, and wherein the resinous binder is selected from the group consisting of polycarbonates and polystyrene; an imaging member wherein the photogenerating pigment present in the photogenerating layer is comprised of chlorogallium phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta+/−0.2°) 7.4, 9.8, 12.4, 16.2, 17.6, 18.4, 21.9, 23.9, 25.0, 28.1 degrees, and the highest peak at 7.4 degrees; a method of imaging, which comprises generating an electrostatic latent image on an imaging member, developing the latent image, and transferring the developed electrostatic image to a suitable substrate; a method of imaging wherein the imaging member is exposed to light of a wavelength of from about 370 to about 950 nanometers; a photoconductive member wherein the photogenerating layer is situated between the substrate and the charge transport layer; a member wherein the charge transport layer is situated between the substrate and the photogenerating layer; a member wherein the photogenerating layer is of a thickness of from about 0.1 to about 50 microns; a member wherein the photogenerating component amount is from about 0.5 weight percent to about 20 weight percent, and wherein the photogenerating pigment is optionally dispersed in from about 1 weight percent to about 80 weight percent of a polymer binder; a member wherein the binder is present in an amount of from about 50 to about 90 percent by weight, and wherein the total of the layer components is about 100 percent; an imaging member wherein the photogenerating component is Type V hydroxygallium phthalocyanine, or chlorogallium phthalocyanine, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine molecules, and wherein the hole transport resinous binder is selected from the group consisting of polycarbonates and polystyrene; an imaging member wherein the photogenerating layer contains a metal free phthalocyanine; an imaging member wherein the photogenerating layer contains an alkoxygallium phthalocyanine; a photoconductive imaging member with a blocking layer contained as a coating on a substrate, and an adhesive layer coated on the blocking layer; a color method of imaging which comprises generating an electrostatic latent image on the imaging member, developing the latent image, transferring and fixing the developed electrostatic image to a suitable substrate; photoconductive imaging members comprised of a supporting substrate, a photogenerating layer, a hole transport layer and a top overcoating layer in contact with the hole transport layer or in embodiments in contact with the photogenerating layer, and in embodiments wherein a plurality of charge transport layers are selected, such as for example, from two to about ten, and more specifically, two may be selected; and a photoconductive imaging member comprised of an optional supporting substrate, a photogenerating layer, and a first, second, and third charge transport layer.

The following Examples are being submitted to illustrate embodiments of the present disclosure.

Comparative Example 1

There was prepared a photoconductor with a biaxially oriented polyethylene naphthalate substrate (KALEDEX™ 2000) having a thickness of 3.5 mils, and thereover, a 0.02 micron thick titanium layer was coated on the biaxially oriented polyethylene naphthalate substrate (KALEDEX™ 2000). Subsequently, there was applied thereon, with a gravure applicator or an extrusion coater, a hole blocking layer solution containing 50 grams of 3-aminopropyl triethoxysilane (γ-APS), 41.2 grams of water, 15 grams of acetic acid, 684.8 grams of denatured alcohol, and 200 grams of heptane. This layer was then dried for about 1 minute at 120° C. in a forced air dryer. The resulting hole blocking layer had a dry thickness of 500 Angstroms. An adhesive layer was then deposited by applying a wet coating over the blocking layer, using a gravure applicator or an extrusion coater, and which adhesive contained 0.2 percent by weight based on the total weight of the solution of the copolyester adhesive (ARDEL™ D100 available from Toyota Hsutsu Inc.) in a 60:30:10 volume ratio mixture of tetrahydrofuran/monochlorobenzene/methylene chloride. The adhesive layer was then dried for about 1 minute at 120° C. in the forced air dryer of the coater. The resulting adhesive layer had a dry thickness of 200 Angstroms.

A photogenerating layer dispersion was prepared by introducing 0.45 gram of the known polycarbonate IUPILON™ 200 (PCZ-200), weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V) and 300 grams of ⅛ inch (3.2 millimeters) diameter stainless steel shot. This mixture was then placed on a ball mill for 8 hours. Subsequently, 2.25 grams of PCZ-200 were dissolved in 46.1 grams of tetrahydrofuran, and added to the hydroxygallium phthalocyanine dispersion. This slurry was then placed on a shaker for 10 minutes. The resulting dispersion was, thereafter, applied to the above adhesive interface with a Bird applicator to form a photogenerating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the ground strip layer that was applied later. The photogenerating layer was dried at 120° C. for 1 minute in a forced air oven to form a dry photogenerating layer having a thickness of 0.4 micron.

The resulting photoconductor web was then coated with a charge transport layer prepared by introducing into an amber glass bottle in a weight ratio of 50/50, N,N'-bis(methylphenyl)-1,1-biphenyl-4,4'-diamine (mTBD) and poly(4,4'-isopropylidene diphenyl) carbonate, a known bisphenol A polycarbonate having a $M_w$ molecular weight average of about 120,000, commercially available from Farbenfabriken Bayer A.G. as MAKROLON® 5705. The resulting mixture was then dissolved in methylene chloride to form a solution containing 15.6 percent by weight solids. This solution was applied on the photogenerating layer to form the charge transport layer coating that upon drying (120° C. for 1 minute) had a thickness of 29 microns. During this coating process, the humidity was equal to or less than 30 percent, for example 25 percent.

Comparative Example 2

A photoconductor was prepared by repeating the process of Comparative Example 1 except that to the charge transport layer (CTL) there was coated a top overcoat layer about 3 microns in thickness (dried at 120° C. for 1 minute) of poly (4,4'-isopropylidene diphenyl) carbonate, a known bisphenol A polycarbonate having a $M_w$ molecular weight average of about 120,000, commercially available from Farbenfabriken Bayer A.G. as MAKROLON® 5705 from a MAKROLON®/methylene chloride overcoat coating solution, which was prepared by simple mixing of the aforementioned components.

Comparative Example 3

A photoconductor was prepared by repeating the process of Comparative Example 1 except that to the charge transport layer (CTL) there was coated a top overcoat layer about 3 microns in thickness (dried at 120° C. for 1 minute) in a weight ratio of 9:91 polytetrafluoroethylene (PTFE) MP-1100 (DuPont) and poly(4,4'-isopropylidene diphenyl) carbonate, a known bisphenol A polycarbonate having a $M_w$ molecular weight average of about 120,000, and commercially available from Farbenfabriken Bayer A.G. as MAKROLON® 5705 from a PTFE/MAKROLON®/methylene chloride overcoat coating dispersion, which was prepared by milling the components with 2 milliliter stainless shots at 200 rpm for 24 hours.

Example I

A photoconductor was prepared by repeating the process of Comparative Example 1 except that to the charge transport layer (CTL) there was coated a top overcoat layer about 3 microns in thickness (dried at 120° C. for 1 minute) in a weight ratio of 1:99 the following fluorinated poly(oxetane) polymer additive

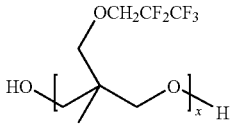

wherein x is 20, as obtained from OMNOVA Solutions Inc. of Akron, Ohio as POLYFOX™ PF-6520, and poly(4,4'-isopropylidene diphenyl) carbonate, a known bisphenol A polycarbonate having a $M_w$ molecular weight average of about 120,000, commercially available from Farbenfabriken Bayer A.G. as MAKROLON® 5705 from a POLYFOX/MAKROLON®/methylene chloride overcoat coating solution, which was prepared by simple mixing of the above components.

Example II

A photoconductor is prepared by repeating the process of Comparative Example 1 except that on the charge transport layer (CTL) there is coated a top overcoat layer about 2 microns in thickness (dried at 120° C. for 1 minute) in a weight ratio of 2:98 the following fluorinated poly(oxetane) polymer additive

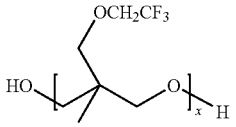

wherein x is 20, as obtained from OMNOVA Solutions Inc. of Akron, Ohio as POLYFOX™ PF-6320, and poly(4,4'-isopropylidene diphenyl) carbonate, a known bisphenol A polycarbonate having a $M_w$ molecular weight average of about 120,000, commercially available from Farbenfabriken Bayer A.G. as MAKROLON® 5705 from a POLYFOX/MAKROLON®/methylene chloride overcoat coating solution, which is prepared by simple mixing of the above components.

Example III

A photoconductor is prepared by repeating the process of Comparative Example 1 except that on the charge transport layer (CTL) there is coated a top overcoat layer about 1 micron in thickness (dried at 120° C. for 1 minute) in a weight ratio of 10:90 the following fluorinated poly(oxetane) polymer additive

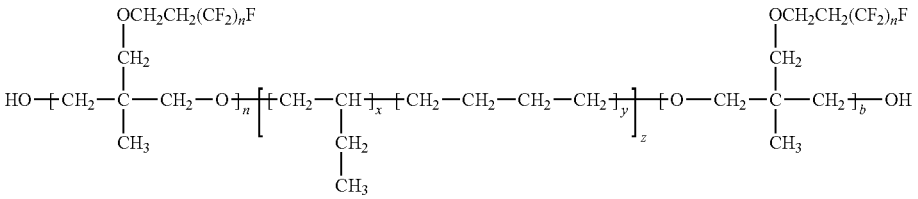

wherein x is about 2; y is about 8; z is about 160; a+b is about 6, and poly(4,4'-isopropylidene diphenyl) carbonate, a known bisphenol A polycarbonate having a $M_w$ molecular weight average of about 120,000, commercially available from Farbenfabriken Bayer A.G. as MAKROLON® 5705 from a fluorinated poly(oxetane)/MAKROLON®/methylene chloride overcoat coating solution, which is prepared by simple mixing of the above components.

Example IV

A photoconductor is prepared by repeating the process of Comparative Example 1 except that on the charge transport layer (CTL) there is coated an overcoat layer about 4 microns in thickness (dried at 120° C. for 1 minute) in a weight ratio of 5:95 the following fluorinated poly(oxetane) polymer additive

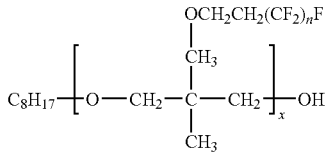

wherein x is about 4.5, and n is about 8, and poly(4,4'-isopropylidene diphenyl) carbonate, a known bisphenol A polycarbonate having a $M_w$ molecular weight average of about 120,000, commercially available from Farbenfabriken Bayer A.G. as MAKROLON® 5705, from a fluorinated poly(oxetane)/MAKROLON®/methylene chloride overcoat coating solution, which is prepared by simple mixing of the above components.

Electrical Property Testing

The above prepared photoconductors of Comparative Examples 1 and 2, and Example I were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The devices were tested at surface potentials of 500 volts with the exposure light intensity incrementally increased by means of regulating a series of neutral density filters; and the exposure light source was a 780 nanometer light emitting diode. The xerographic simulation was completed in an environmentally controlled light tight chamber at ambient conditions (40 percent relative humidity and 22° C.).

The photoconductors of Comparative Examples 1 and 2, and Example I exhibited substantially similar PIDCs with a slight increase in residual potential for the photoconductors of Comparative Example 2 and Example I when compared with the photoconductor of Comparative Example 1 (without any overcoat) because primarily of the extra 3 micron distance to transport charge from the overcoat layer. Thus, incorporation of the fluorinated poly(oxetane) additive into the top overcoat layer did not substantially adversely affect the electrical properties of the Example I photoconductor.

Contact Angle Measurements

The advancing contact angles of deionized water on the surface layers of Comparative Examples 1, 2 and 3, and Example I photoconductors were measured at ambient temperature (about 23° C.), using Contact Angle System OCA (Dataphysics Instruments GmbH, model OCA15). At least ten measurements were performed, and their averages and standard deviations are reported in Table 1.

TABLE 1

| | Contact Angle | Friction Coefficient |
|---|---|---|
| Comparative Example 1 | 90 ± 2° | 0.40 ± 0.01 |
| Comparative Example 2 | 83 ± 1° | 0.41 ± 0.01 |
| Comparative Example 3 | 80 ± 0° | 0.37 ± 0.01 |
| Example I | 97 ± 0° | 0.33 ± 0.00 |

The contact angle measurements for the overcoat layer of the Example I photoconductor indicated that the incorporation of the fluorinated poly(oxetane) polymer into the overcoat layer lowered the surface energy (higher contact angle) by about 10 to about 20 percent when compared with those of the Comparative Example 1 (no overcoat), Comparative Example 2 (MAKROLON® overcoat), and Comparative Example 3 (PTFE-doped overcoat) photoconductors, noting, for example, that incorporation of PTFE microparticles into the overcoat layer did not increase the contact angle.

Friction Coefficient Measurements

The coefficients of kinetic friction of the surface layers of Comparative Examples 1, 2 and 3, and Example I photoconductors against polished stainless steel surface were measured by COF Tester (Model D5095D, Dynisco Polymer Test, Morgantown, Pa.) according to ASTM D1894-63, procedure A. The tester was facilitated with a 2.5"×2.5", 200 gram weight with rubber on one side, a moving polished stainless steel sled, and a DFGS force gauge (250 gram maximum). The photoconductors were cut into 2.5"×3.5" pieces and taped onto the 200 gram weight on the rubber side with the surfaces to be tested facing the sled. The coefficient of kinetic friction was defined as the ratio of the kinetic friction force (F) between the surfaces in contact to the normal force: F/N, where F was measured by the gauge and N is the weight (200 grams). The measurements were conducted at the sled speed of 6"/minute and at ambient conditions. Three measurements were performed for each photoconductor, and their averages and standard deviations were reported in Table 1.

The friction coefficient measurements for the overcoat layer of the Example I photoconductor also indicated that the incorporation of the fluorinated poly(oxetane) polymer into the overcoat layer lowered the surface energy (lower friction coefficient) by about 20 percent when compared with those of the Comparative Example 1 photoconductor (no overcoat) and Comparative Example 2 (MAKROLON™ overcoat) photoconductor, and was about 10 percent lower than that of the Comparative Example 3 photoconductor (PTFE-doped overcoat).

While the wear or scratch resistance of the disclosed overcoat layer was not specifically measured, it is believed that the disclosed photoconductors with the overcoat layers containing the fluorinated poly(oxetane) polymer are more wear or scratch resistant than the Comparative Examples 1 and 2 surface layers due primarily to their lower surface energies, and are comparable in wear or scratch resistance to the Comparative Example 3 photoconductor with the PTFE-doped overcoat layer.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a supporting substrate, a photogenerating layer, and at least one charge transport layer comprised of at least one charge transport component, and in contact with said charge transport layer an overcoat layer comprised of a polymer, an optional charge transport component, and a soluble fluorinated poly(oxetane) polymer in an amount of from about 0.05 to about 20 weight percent.

2. A photoconductor in accordance with claim 1 wherein said fluorinated poly(oxetane) polymer is a fluorinated poly (oxetane) homopolymer represented by the following structures/formulas

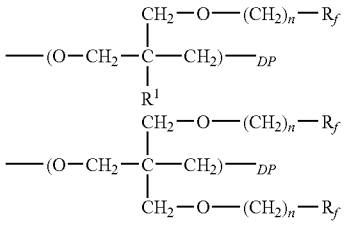

wherein $R^l$ is an alkyl having from 1 to 6 carbon atoms or hydrogen; n represents the number of repeating segments; $R_f$ is a fluorinated aliphatic group having from 1 to about 30 carbon atoms; and DP represents the degree of polymerization.

3. A photoconductor in accordance with claim 2 wherein said fluorinated poly(oxetane) homopolymer is polymerized from a plurality of fluorinated oxetane monomers represented by the following structures/formulas

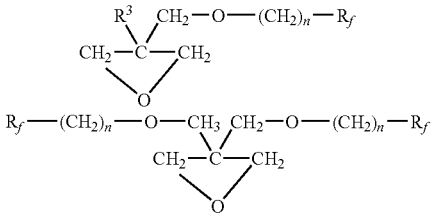

wherein $R^l$ is an alkyl having from 1 to 4 carbon atoms; n is independently an integer from 1 to about 4; and $R_f$ is a fluorinated aliphatic group having from 3 to about 15 carbon atoms.

4. A photoconductor in accordance with claim 2 wherein said fluorinated poly(oxetane) homopolymer is represented by the following structures/formulas

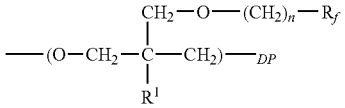

-continued

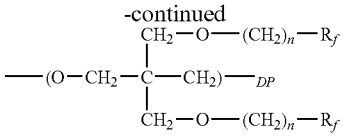

wherein $R^l$ is methyl; n is from 1 to about 2; $R_f$ is a perfluorinated linear aliphatic group having from 1 to about 10 carbon atoms; and DP is from 3 to about 50.

5. A photoconductor in accordance with claim 1 wherein said fluorinated poly(oxetane) polymer is a fluorinated poly (oxetane) copolymer of a fluorinated poly(oxetane) and an olefin polymer or copolymer, or a hydrogenated diene polymer or copolymer.

6. A photoconductor in accordance with claim 5 wherein said fluorinated poly(oxetane) copolymer is a block copolymer of a fluorinated poly(oxetane) and an olefin polymer or copolymer, and said fluorinated poly(oxetane) block is represented by the following structures/formulas

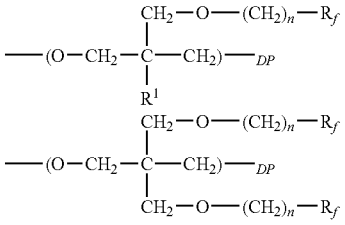

wherein $R^l$ is an alkyl having from 1 to 6 carbon atoms or hydrogen; n is from 1 to about 6; $R_f$ is a fluorinated aliphatic group having from 1 to about 30 carbon atoms; and DP is from 2 to about 100; and said olefin polymer or copolymer block is derived from at least one olefin monomer having from 2 to about 8 carbon atoms with a number average molecular weight of from about 200 to about 4,000.

7. A photoconductor in accordance with claim 6 wherein $R^l$ is methyl; n is from 1 to about 2; $R_f$ is a perfluorinated linear aliphatic group having from 1 to about 10 carbon atoms; and DP is from 3 to about 50 of said fluorinated poly(oxetane) block.

8. A photoconductor in accordance with claim 5 wherein said fluorinated poly(oxetane) copolymer is a block copolymer of a fluorinated poly(oxetane) and a hydrogenated diene polymer or copolymer, and said fluorinated poly(oxetane) block is represented by the following structures/formulas

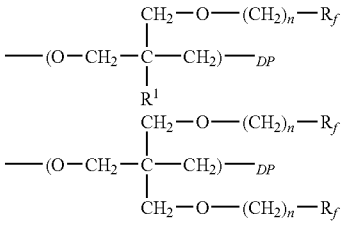

wherein $R^l$ is an alkyl having from 1 to 6 carbon atoms or hydrogen; n is from 1 to about 6; $R_f$ is a fluorinated aliphatic group having from 1 to about 30 carbon atoms; and DP is from 2 to about 100; and said hydrogenated diene polymer or copolymer block is derived from at least one conjugated diene monomer having from 4 to about 10 carbon atoms with a number average molecular weight of from about 500 to about 15,000.

9. A photoconductor in accordance with claim 8 wherein $R^l$ is methyl; n is from 1 to about 2; $R_f$ is a perfluorinated linear aliphatic group having from 1 to about 10 carbon atoms; and DP from 3 to about 50 of said fluorinated poly(oxetane)

block, and said hydrogenated diene polymer or copolymer block possesses a number average molecular weight of from about 1,000 to 8,000.

10. A photoconductor in accordance with claim 1 wherein said fluorinated poly(oxetane) polymer is selected from a group consisting of the following structures/formulas

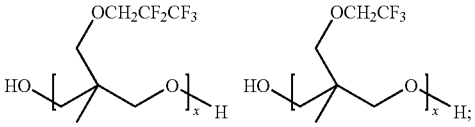

wherein x is about 6, or about 20

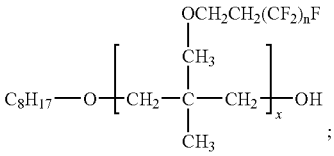

wherein x is about 4.5, and n is about 8

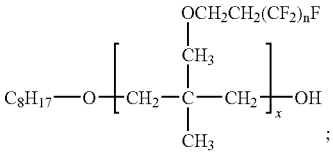

wherein x is about 18, and n is about 8

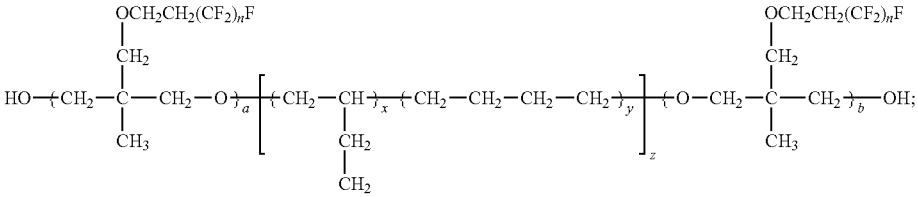

wherein x is about 2; y is about 8; z is about 160; a + b is about 6, and n is about 8 and wherein the supporting substrate is comprised of a single layer.

11. A photoconductor in accordance with claim 1 wherein said charge transport component is comprised of at least one of aryl amine molecules

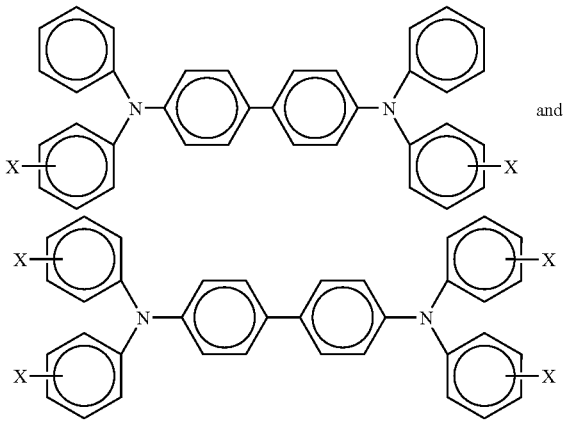

and wherein X is selected from the group consisting of at least one of alkyl, alkoxy, aryl, and halogen.

12. A photoconductor in accordance with claim 11 wherein said alkyl and said alkoxy each contains from about 1 to about 12 carbon atoms, and said aryl contains from about 6 to about 36 carbon atoms.

13. A photoconductor in accordance with claim 11 wherein said aryl amine is N,N'-diphenyl-N,N-bis(3-methylphenyl)-1,1'-biphenyl-4,4'-diamine.

14. A photoconductor in accordance with claim 1 wherein said charge transport component is comprised of

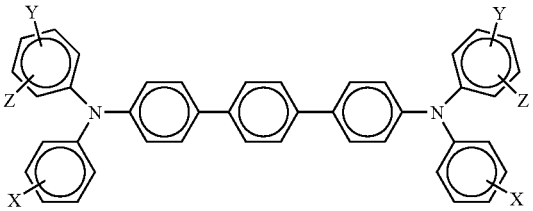

wherein X, Y and Z are independently selected from the group consisting of at least one of alkyl, alkoxy, aryl, and halogen.

15. A photoconductor in accordance with claim 14 wherein alkyl and alkoxy each contains from about 1 to about 12 carbon atoms, and aryl contains from about 6 to about 36 carbon atoms.

16. A photoconductor in accordance with claim 1 wherein said charge transport component is an aryl amine selected from the group consisting of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, and optionally mixtures thereof.

17. A photoconductor in accordance with claim 1 wherein said charge transport component is comprised of aryl amine mixtures.

18. A photoconductor in accordance with claim 1 wherein said member further includes in at least one of said charge transport layers and overcoat layer an antioxidant comprised of a hindered phenolic and a hindered amine.

19. A photoconductor in accordance with claim 1 wherein said photogenerating layer is comprised of a photogenerating pigment or photogenerating pigments.

20. A photoconductor in accordance with claim 19 wherein said photogenerating pigment is comprised of at least one of a metal phthalocyanine, metal free phthalocyanine, a bis(benzimidazo)perylene, and mixtures thereof.

21. A photoconductor in accordance with claim 1 further including a hole blocking layer, and an adhesive layer, and wherein said substrate is comprised of a conductive material.

22. A photoconductor in accordance with claim 1 wherein said substrate is a flexible web.

23. A photoconductor in accordance with claim 1 wherein said at least one charge transport layer is from 1 to about 7 layers.

24. A photoconductor in accordance with claim 1 wherein said at least one charge transport layer is from 1 to about 2 layers.

25. A photoconductor in accordance with claim 1 wherein said at least one charge transport layer is comprised of a top charge transport layer and a bottom charge transport layer, and wherein said top layer is in contact with said overcoating layer, and said bottom layer is in contact with said photogenerating layer.

26. A photoconductor comprised in sequence of a supporting substrate, a photogenerating layer thereover, a charge transport layer, and in contact with and contiguous to said charge transport layer an overcoat layer comprised of a polymer, a charge transport component and an additive, wherein the additive is comprised of at least one of the following structures/formulas

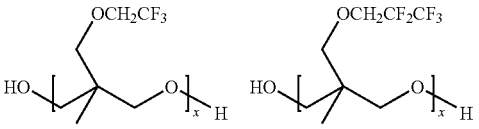

wherein x represents the number of repeating units or segments of from about 3 to about 30.

27. A photoconductor in accordance with claim 26 wherein said additive is present in an amount of from about 0.05 to about 20 weight percent.

28. A photoconductor in accordance with claim 26 wherein said additive is present in an amount of from about 0.5 to about 10 weight percent.

29. A photoconductor in accordance with claim 26 wherein said top layer is of a thickness of from about 0.5 to about 10 microns, and wherein said additive is present in an amount of from about 1 to about 5 weight percent.

30. A photoconductor comprised in sequence of a supporting substrate, a photogenerating layer thereover, a charge transport layer, and an overcoat layer comprised of a fluorinated poly(oxetane) polymer additive of at least one of the following formulas/structures

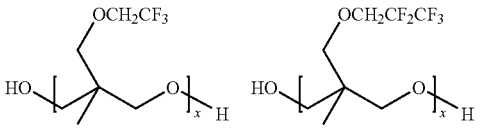

wherein x represents a number of from about 3 to about 50, and which additive is present in an amount of from about 0.5 to about 30 weight percent.

31. A photoconductor in accordance with claim 1 wherein the fluorinated poly(oxetane) polymer additive is present in an amount of from about 0.1 to about 10 weight percent; and which layer further includes a polymer present in an amount of from about 40 to about 99.9 weight percent, and a charge transport component present in an amount of from about 0 to about 50 weight percent, and the total component amount is 100 weight percent.

32. A photoconductor in accordance with claim 1 wherein said additive is of the following formula/structure

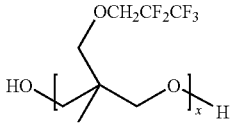

and is present in an amount of from about 1 to about 5 weight percent, and wherein x is from about 3 to about 30.

33. A photoconductor in accordance with claim 2 wherein n is from 1 to 6, and DP is from 2 to 100.

* * * * *